United States Patent [19]

Josemans

[11] 4,168,416

[45] Sep. 18, 1979

[54] GUARDED SAFETY SWITCH WITH INTEGRAL OFF-LOCK AND ACTUATOR NON-REMOVABLE IN ON POSITION

[75] Inventor: Leonardus J. Josemans, Smithfield, N.C.

[73] Assignee: Cutler-Hammer, Inc., Milwaukee, Wis.

[21] Appl. No.: 883,957

[22] Filed: Mar. 6, 1978

[51] Int. Cl.[2] ..... H01H 3/02

[52] U.S. Cl. ..... 200/323; 200/42 T

[58] Field of Search ..... 200/321, 42 R, 42 T, 200/322, 323, 68, 67 G

[56] References Cited

U.S. PATENT DOCUMENTS

| | | | |
|---|---|---|---|
| 2,771,521 | 11/1956 | Cressman et al. | 200/42 R |
| 3,321,589 | 5/1967 | Persia et al. | 200/42 R |
| 3,497,646 | 2/1970 | Pollak | 200/42 T |
| 3,527,914 | 9/1970 | Spacek | 200/42 T |
| 4,013,858 | 3/1977 | Grebner et al. | 200/321 |

*Primary Examiner*—Willis Little

*Attorney, Agent, or Firm*—Hugh R. Rather; William A. Autio; Michael E. Taken

[57] ABSTRACT

A pivoted-actuator safety switch of the type having a spring-biased lock lever within the sub-actuator that extends out to catch beneath the rim of the hole in the switch frame or housing to lock the pivoted-actuator in its "off" position, and a removable insertable actuator, covering the sub-actuator, has a projecting cam effective when inserted to retract the lock lever to allow normal operation, but removal thereof prevents unlocking of the sub-actuator and thus prevents operation from "off" to "on". A half-guard integral with the frame guards the actuator in "off" position to meet the "palm test", that is, it cannot be turned on accidentally by bumping or striking with the palm of the hand, while providing open access to the actuator in its "on" position so that it can be quickly turned off. This half-guard consists of upstanding plates integral with the frame on opposite sides of and extending higher than the actuator in "off" position. Lateral projections on the pivotal actuator enter slots in these plates to render the actuator non-removable in "on" position but allow removal in "off" position.

8 Claims, 5 Drawing Figures a hole in a mounting panel when the switch is snap-in inserted therein all the way to its bezel.

Frame 4 has integral end and side walls 4m below its bezel with the lower edges thereof abutting the upper edge of the base with a sealing gasket 24 therebetween to seal switch compartments 2a and 2b from the outside and prevent dirt from getting thereinto as shown in FIGS. 2 and 4. The bottom of these walls is closed at both ends by integrally molded horizontal plate portion 4n and 4p as shown in FIG. 3 with a rectangular aperture therebetween for closely receiving pivotal sub-actuator 6.

The center portion of this seal within the base has an H-shaped cut through which sub-actuator 6 is pushed in during assembly so that the depressed flaps 24a and 24b of this seal hug the sub-actuator as shown in FIG. 3 to seal contact compartments 2a and 2b from contamination. The two side walls are provided with central aligned externally recessed holes 4q and 4r as shown in FIG. 2 and 4 for pivotally supporting the sub-actuator by its two oppositely-extending short trunnions. These trunnions have beveled ends so that they can be snap-in assembled into these holes, the side walls 4m being resilient and spreading enough when the sub-actuator is pressed therebetween to allow the trunnions to snap into their holes.

As shown in FIGS. 3–5, sub-actuator 6 has three molded parts and a spring 26. These parts comprise two like contact actuator halves 6a and 6b and a lock lever 28 confined therebetween for limited movement. These contact actuator halves are provided with means for operating the movable contacts such as movable contact 22. For this purpose, each contact actuator half is provided with a bore extending up from its lower, reduced end portion for retaining a spring-biased plunger 30, as shown in FIGS. 3 and 4 and more fully shown and described in the aforementioned Grebner et al patent. This plunger slides along and rockably actuates the on-off movable contact 22 when the sub-actuator is pivotally actuated. A helical spring, not shown herein, within this bore biases plunger 30 downwardly against contact 22.

These contact actuator halves of the sub-actuator are also provided therebetween with a guiding slot allowing limited reciprocal, longitudinal sliding movement of the lock lever and the latter is provided with a suitable configuration to cooperate therewith. For this purpose, molded insulating lock lever 28, as shown in FIG. 3 is provided at one end with a tip 28a which, when extended out from the sub-actuator, catches below and engages the rim of plate portion 4m of the frame when the actuator is removed. This lock lever is also provided with a pair of lateral wings 28b having cam surfaces thereon for engagement by complementary cam surfaces 8a on a pair of projections 8b of removable actuator 8. These lateral wings are suitably spaced from upper and lower stop projections 28c on this lock lever as shown in FIG. 3 so that they are positioned within the slots into which projections 8b of the actuator are inserted when the lock is to be released. Actuator 8 is also provided with two additional similar projections 8c as shown in FIGS. 3 and 5 that slide into holes in the sub-actuator for retaining it securely on the latter and to prevent any relative motion therebeteen when the switch is operated, and for releasing the lever lock if it is turned 180 degrees and then inserted, since it is symmetrical. The guiding slot for the lock lever is provided with a suitable constriction forming a stop for vertical projections 28c to limit the outward extension thereof under the force of its bias spring 26.

These two contact actuator halves are kept in registration with one another by a plurality of suitable projections on one half fitting into complementary wells in the other half. With such interfitting engagement, the two havles are then held snugly between side walls 4m of the frame with their trunnions in the holes in these side walls.

Actuator 8 is shown in the form of a rocker button, but may have any one of a variety of shapes, such as for example, a toggle lever, a paddle lever, or the like, the important thing being that it constitutes along with the sub-actuator a pivoted actuator assembly whereby the tip of lock lever 28 swings past the edge of plate portion 4n of the frame in normal use and will catch therebelow to lock the switch "off" when the actuating member or button is removed as instructed by the legends "on" and "off" and "remove to lock" shown in FIG. 1. This actuator 8 serves not only as the manually engageable part for operating the switch but also as the removable "key" leaving the switch locked in its "off" position. For this purpose, this actuator is provided with the aforementioned cam-ended projections 8b for engaging the wing-cams of the lock lever to withdraw the latter entirely into the sub-actuator and free of the frame edge when this actuator is snapped in place. For snap-in retention, the actuator is provided with two symmetrically arranged pairs of hooks, one pair of these hooks 8d, 8e being shown in FIG. 4. These hooks slide along stepped grooves in opposite sides of the sub-actuator and snap into the deeper end portions of the grooves to lock the actuator to the sub-actuator while allowing removal thereof by a direct pull.

This actuator is also provided with a finger engaging portion 8f having a generally stepped convex shape for cooperation with the guard hereinafter described. As shown in FIG. 1, the "on" end of this actuator is high when the switch is "off", and the "off" end will be high when the switch is turned "on". For this reason, the half guard is placed at the "on" end of the actuator to guard it in its "off" position to prevent it from being turned "on" accidentally as by a bump or slap with the palm of the hand. This guard comprises a pair of upstanding guard plates 4s and 4t, one on each side of the actuator and integral with the bezel of the frame. These guard plates are vertical on their outer surfaces and are tapered outwardly on their inner surfaces to enlarge the space therebetween to receive the operator's finger for turning the switch "on" and to facilitate insertion of the sub-actuator therebetween during assembly as shown in FIG. 4. These guard plates overlap the end portion of the actuator as shown in FIG. 2 and rise above the "on" end of the actuator in its upper-most "off" position. In this manner, these guard plates prevent accidental actuation of the switch from "off" to "on" such as by a "blow" and require the deliberate placing of the finger between the guard plates to depress the end of the actuator from "off" to "on". When so actuated, the "off" end of the actuator rises up in the open space to the left of the guard in FIG. 2 to be freely accessible for turning the switch from "on" to "off".

When the switch is "off", actuator 8 may be removed to lock the switch "off". This actuator is removed from the position shown in FIG. 2 by grasping it by its opposite side ledges 8g and 8h shown in FIGS. 1, 2 and 4 and pulling it straight up and out from the sub-actuator. As a result, lock lever 28 is released and spring 26 extends

GUARDED SAFETY SWITCH WITH INTEGRAL OFF-LOCK AND ACTUATOR NON-REMOVABLE IN ON POSITION

BACKGROUND OF THE INVENTION

So-called key actuated switches have been known heretofore. For example, R. C. Cressman et al U.S. Pat. No. 2,771,521, dated Nov. 20, 1956, shows a key actuated switch wherein the key is provided with a notch in one edge of its stem adjacent to the handle. This prevents turning of the key if incorrectly inserted into the keyhole and allows use of only a special key to operate the switch. The key is the movable contact of the switch. Also, R. J. Persia et al U.S. Pat. No. 3,321,589, dated May 23, 1967, shows a safety lock switch for a punch press. A safety block is chained to the key and the key is removable from the lock only when the lock switch is "off". Therefore, the safety block can be placed between the dies of the press only when it is "off" for safety. Furthermore, S. W. Grebner U.S. Pat. No. 4,013,858, dated Mar. 22, 1977, assigned to the assignee of this invention, shows a rocker switch with integral off-lock that has a locking mechanism generally similar to that used in the present invention.

While these prior devices have been useful for their intended purposes, this invention relates to improvements thereover.

SUMMARY OF THE INVENTION

An object of the invention is to provide an improved safety switch.

A more specific object of the invention is to provide a safety lock-off switch of the type having a removable actuator that is insertable to release the lock with improved means making the actuator non-removable when the switch is in its "on" position.

Another specific object of the invention is to provide a safety lock-off switch of the type having a removable actuator that is insertable to release the lock with improved means rendering the actuator removable only when the switch is in its "off" position.

Another specific object of the invention is to provide a safety lock-off switch of the type having a removable actuator that is insertable in place to release the lock with improved means serving both to guard the actuator in its "off" position to prevent accidentally bumping it "on" while allowing unguarded access in its "on"0 position to turn it "off" and to render the actuator non-removable in "on" position.

Another specific object of the invention is to provide an improved safety lock-off switch of the aforementioned type that is simple in construction and reliable in operation.

Other objects and advantages of the invention will hereinafter appear.

DESCRIPTION OF THE PREFERRED EMBODIMENT

Figure 1:
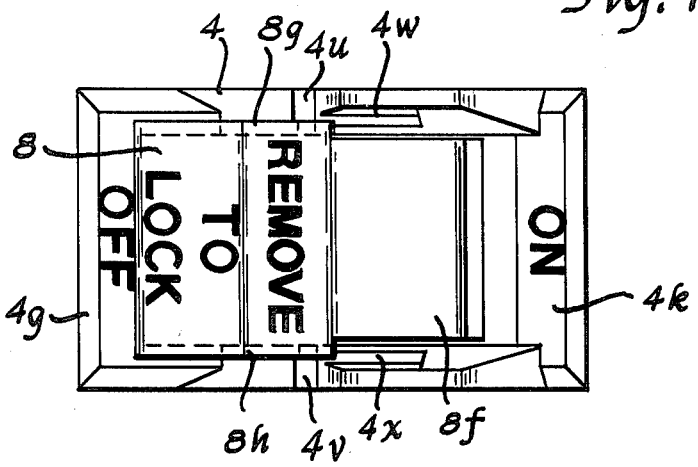
FIG. 1 is an enlarged top view of a guarded safety switch with integral off-lock and actuator non-removable in "on" position constructed in accordance with the invention.
Figure 2:
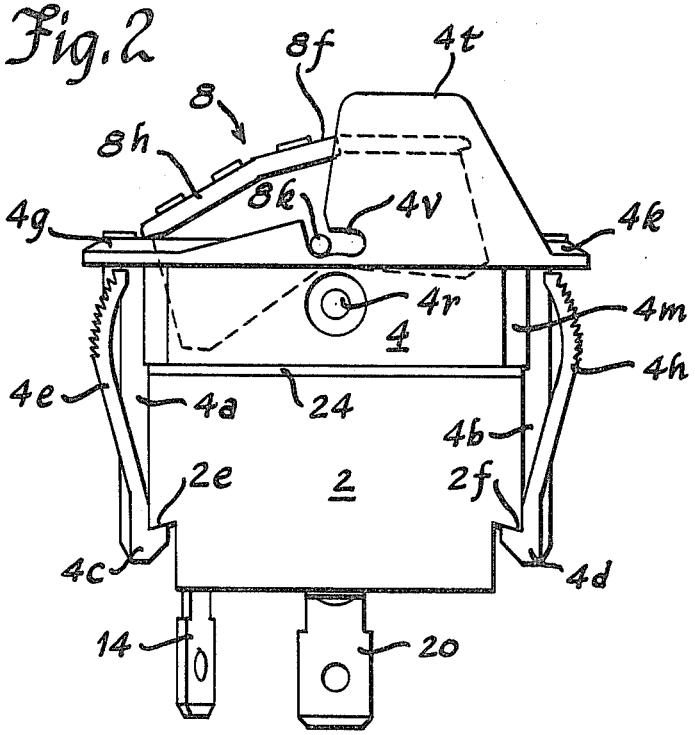
FIG. 2 is a side elevational view of the guarded safety switch of FIG. 1 showing the profile of the two guard elements and the actuator retaining slots with respect to the removable actuator.

Referring to FIGS. 1 and 2, there are two exterior views showing the guarded safety switch including the actuator nonremovable in "on" position but with its integral off-lock not visible, it being within the housing. As shown therein, this safety switch is provided with a housing comprising a molded insulating base 2 and frame 4. This base is a generally rectangular cup-shaped member having an open top that is closed by the frame and an actuator assembly, the latter being pivotally supported on the frame as hereinafter described. This base is arranged to accommodate double-pole single-throw switch contacts; however, only one pole, or set of contacts, is shown for illustrative purposes in FIGS. 3 and 4 since the other set of contacts, or pole, is similar.

Figure 4:
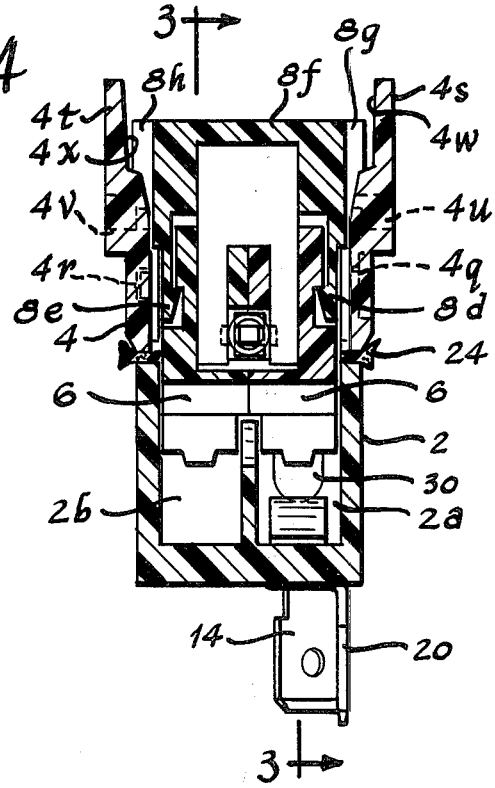
FIG. 4 is a cross-sectional view taken substantially along line 4—4 of FIG. 3 to show the removable actuator snap-in hooks, a pair of lock releasing projections, and the contact compartments in the base.
Figure 3:
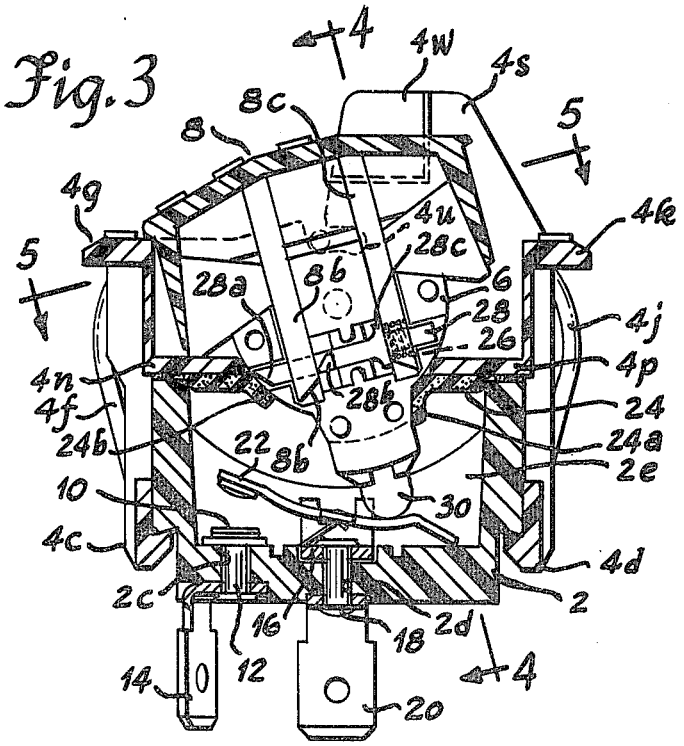
FIG. 3 is a vertical cross-sectional view taken substantially along line 3—3 of FIG. 4 to show the internal parts including the switch contacts, seal, off-lock, and one lock releasing projection of each of the two symmetrical pairs thereof.

As shown in FIGS. 3 and 4, the actuator assembly comprises a sub-actuator 6 pivotally mounted on the frame and a snap-in, removable, lock releasing actuator 8 hereinafter more fully described.

Base 2 is provided with two compartments 2*a* and 2*b* having means for supporting two sets of stationary and movable contacts. For this purpose, the flat bottom of the base is provided wih a plurality of round holes 2*c* and 2*d* shown in FIG. 3 through which rivets extend to connect internal stationary contacts to external terminals hereinafter described. As shown in FIG. 3, there is a left end stationary contact 10 connected by a rivet 12 through hole 2*c* to an external terminal 14. And there is a central stationary contact 16 connected by a rivet 18 through hole 2*d* to an external terminal 20. Left end stationary contact 10 is in the form of a flat coined element similar to a rivet head whereas central stationary contact 16 is in the form of a stationary cradle for rockably supporting a two-position movable bridging contact 22 in a manner known in the art. A similar set of contacts, not shown, may be provided for the other pole of the switch in the other contact compartment 2*b*.

Frame 4 has a pair of inverted T-shaped legs 4*a* and 4*b* that embrace the ends of the base and their laterally wider lower ends have hooks 4*c* and 4*d*, respectively, that snap beneath undercut shoulders 2*e* and 2*f* at the opposite ends of the base to secure the base to the frame. As shown in FIGS. 2 and 3, a pair of snap-in retention elements 4*e* and 4*f* extend upwardly from the lower end lateral portions of leg 4*a* on opposite sides of leg 4*a* almost to left end bezel portion 4*g* of the frame. Similarly, a pair of snap-in retention elements 4*h* and 4*j* extend upwardly from the lower end lateral portions of leg 4*b* on opposite sides of leg 4*b* almost to right end bezel portion 4*k*. These resilient retention elements are outwardly bowed at their upper end portions and are serrated on their outer surfaces so as to grip the rim of tip 28*a* below the rim of plate portion 4*n* of the frame to lock the switch "off". This of course prevents unauthorized operation of the switch and also the power tool or the like on which it is mounted.

Figure 5:
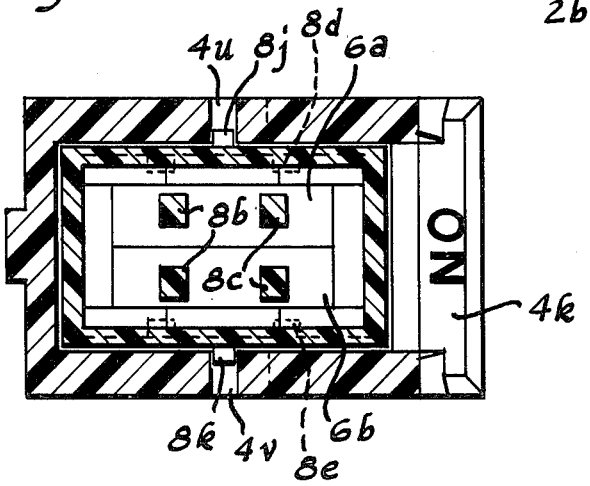
FIG. 5 is a cross-sectional view taken substantially along line 5—5 of FIG. 3 to show the entry portions of the actuator retaining slots and the symmetrical arrangement of the two pairs of lock releasing projections and two pairs of snap-in hooks.

This actuator is also provided with means rendering it non-removable in "on" position as a safety measure to avoid leaving the tool running without an easy way to turn it "off". This means comprises a pair of grooves or slots 4*u* and 4*v* in guard plates 4*s* and 4*t*, respectively, that constitute a part of the frame or housing and a pair of oppositely extending short cylindrical lugs or projections 8*j* and 8*k* extending into the respective slots as shown in FIGS. 2 and 5. These slots have a substantially vertical entry portion and a substantially horizontal locking portion, the latter being arcuate as shown in FIG. 2 to conform to the arc of travel of the corresponding actuator projection when the switch is turned "on". As will be apparent in FIG. 2, actuator 8 is removable and insertable in its "off" position with projections 8*j* and 8*k* passing freely through the entry portions of the corresponding slots 4*s* and 4*t*. However, when the actuator is pivoted to "on" position, projections 8*j* and 8*k* move into the arcuate portions of these slots to prevent removal of the actuator. In this manner, the switch must always be turned "off" first before the lock can be made effective. Ledges 8*g* and 8*h* which facilitate gripping of the actuator to pull it free are provided with clearance in the guard plates in the form of cutouts 4*w* and 4*x* as shown in FIGS. 1, 3 and 4 to prevent interference when the switch is turned "on".

While the apparatus hereinbefore described is effectively adapted to fulfill the objects stated, it is to be understood that the invention is not intended to be confined to the particular preferred embodiment of guarded safety switch with integral off-lock and actuator non-removable in "on" position disclosed, inasmuch as it is susceptible of various modifications without departing from the scope of the appended claims.

I claim:

1. A self-enclosed pivot-actuator guarded safety switch comprising:
- an insulating housing;
- stationary contact means within said housing connected to external terminals;
- movable contact means within said housing selectively operable to an "on" position closing a circuit with respect to said stationary contact means or to an "off" position opening said circuit;
- an actuator assembly;
- supporting means on said housing pivotally mounting said actuator assembly for reciprocal movement to actuate said movable contact means;
- said actuator assembly comprising:
- contact actuator means extending from said pivotal supporting means into said housing for actuating said movable contact means to said "on" or "off" position;
- a spring-biased locking member having a locking position and an unlocking position and projecting from said contact actuator means in its said locking position to catch on said housing thereby to prevent pivotal movement of said actuator assembly;
- and a removable operating member having a manually-engageable portion and means for coupling the same to said contact actuator means so that selective actuation thereof by said manually-engageable portion effects pivotal movement of both said removable operating member and said contact actuator means coupled thereto and means on said removable operating member which when inserted into said contact actuator means together with said coupling thereof moves said locking member against the force of its bias spring into said unlocking position clear of said housing to afford normal pivotal movement of said actuator assembly;
- and said switch further comprising:
- guard means on said housing guarding said operating means in its "off" position to prevent accidental actuation thereof into "on" position;
- and means rendering said operating member non-removable in its "on" position.

2. The self-enclosed pivoted-actuator guarded safety switch claimed in claim 1, wherein:
- said means rendering said operating member non-removable it its "on" position comprises interlocking means between said operating member and said guard means effective only in said "on" position of said switch.

3. The self-enclosed pivoted-actuator guarded safety switch claimed in claim 1, wherein:
- said guard means comprises plates on said housing overlapping and extending above said operating member on opposite sides thereof when said operating member is in its "off" position to shield it from being bumped "on" while providing access therebetween for the user's finger for deliberately pivoting said operating member to its "on" position, and leaving said operating member exposed in its "on" position for easily turning it "off";
- and said means rendering said operating member non-removable comprises complementary means on said operating member and said guard plates allowing removal of said operating member only in its "off" position.

4. The self-enclosed pivoted-actuator guarded safety switch claimed in claim 3, wherein:
- said complementary means comprises lug and slot means between said operating member and said guard plates normally unengaged in said "off" position of said switch and becoming engaged upon pivotal movement of said operating member into its "on" position to prevent removal of said operating member from said contact actuator means.

5. The self-enclosed pivoted-actuator guarded safety switch claimed in claim 4, wherein:
- said lug and slot means comprises a projection on each side of said operating member;
- and a slot on each said guard plate, each slot having an entry portion for receiving the corresponding lug when said contact actuator means is in its "off" position thereby to allow insertion of said operating member to release said locking member and a locking portion leading from said entry portion for receiving the corresponding lug when said operating member is actuated to "on" position thereby to prevent removal of said operating member.

6. The self-enclosed pivoted-actuator guarded safety switch claimed in claim 5, wherein:
- said locking portion of said slot is arcuate to conform to the path of travel of the corresponding lug when said operating member is pivotally actuated into its "on" position.

7. A pivoted-actuator safety switch comprising:
- an insulating housing comprising a base and frame attached thereto;

stationary contact means within said base connected to external terminals;

movable contact means within said base selectively operable to an "on" position closing a circuit with respect to said stationary contact means or to an "off" position opening said circuit;

an actuator assembly;

supporting means on said frame pivotally mounting said actuator assembly for reciprocal movement to actuate said movable contact means;

said actuator assembly comprising:

a sub-actuator extending from said pivotal supporting means into said base for actuating said movable contact means to said "on" or "off" position;

a spring-biased locking member having a locking position and an unlocking position and projecting from said sub-actuator in its said locking position to catch on an edge of said frame thereby to prevent pivotal movement of said actuator assembly;

and a removable actuator having an external manually-engageable part and means for coupling the same to said sub-actuator so that selective actuation thereof by said manually-engageable part effects pivotal movement of both said removable actuator and said sub-actuator coupled thereto and means on said removable actuator which when inserted into said sub-actuator together with said coupling thereof moves said locking member against the force of its bias spring into said unlocking position clear of said frame edge to afford normal pivotal movement of said actuator assembly;

and interlocking means between said actuator and said frame preventing removal of said actuator in its "on" position.

8. The pivoted-actuator safety switch claimed in claim 7, wherein said interlocking means comprises:

lateral projections on said actuator;

projections on said frame rising up on opposite sides of said actuator;

and locking recesses on said frame projections for receiving said lateral projections when said actuator is moved from "off" to "on" position to prevent removal of said actuator.

* * * * *